US005828938A

United States Patent [19]

Hazama et al.

[11] Patent Number: 5,828,938

[45] Date of Patent: Oct. 27, 1998

[54] TRANSFERRING DEVICE AND IMAGE FORMING APPARATUS USING THE SAME

[75] Inventors: Hiroyuki Hazama; Masaru Watanabe; Takashi Terada; Hirotsugu Ogawa; Toru Ueno, all of Osaka, Japan

[73] Assignee: Mita Industrial Co., Ltd., Osaka, Japan

[21] Appl. No.: 813,073

[22] Filed: Mar. 7, 1997

[30] Foreign Application Priority Data

Mar. 13, 1996 [JP] Japan ..... 8-056178
Jan. 20, 1997 [JP] Japan ..... 9-007943

[51] Int. Cl.[6] ..... G03G 15/16

[52] U.S. Cl. ..... 399/313; 399/159

[58] Field of Search ..... 399/297, 310, 399/313, 314, 107, 121, 130, 159

[56] References Cited

U.S. PATENT DOCUMENTS 5,243,395 9/1993 Koike et al. ..... 399/297 X
5,386,279 1/1995 Fukami et al. ..... 399/313
5,392,103 2/1995 Kukimoto et al. ..... 399/314
5,406,360 4/1995 Asai ..... 399/313
5,594,537 1/1997 Hasegawa ..... 399/310 X
5,669,053 9/1997 Hashizume et al. ..... 399/313

*Primary Examiner*—Arthur T. Grimley
*Assistant Examiner*—Hoan Tran
*Attorney, Agent, or Firm*—Beveridge, DeGrandi, Weilacher & Young, LLP

[57] ABSTRACT

A transferring device in which a transfer roller having a diameter which is not less than 60% of the diameter of an organic photosensitive drum with a diameter of 10 to 20 mm is arranged with a clearance provided between the transfer roller and the organic photosensitive drum. The transferring device avoids problems such as current leakage and reverse transfer of toner in the case of miniaturization of an image forming apparatus or contamination of the transfer roller, and easily sets a transfer current because an effective transfer current width is large.

6 Claims, 1 Drawing Sheet

TRANSFERRING DEVICE AND IMAGE FORMING APPARATUS USING THE SAME

BACKGROUND OF THE INVENTION

This application is based on application Nos. 8-056178 and 9-007943 filed in Japan, the content of which is incorporated hereinto by reference.

The present relates generally to a transferring device using a transfer roller and an image forming apparatus using the same.

In an electrophotographic type image forming apparatus, image formation has been performed by charging and exposing a photosensitive drum, to form an electrostatic latent image, developing the electrostatic latent image by a developer containing charged toner, to form a toner image, and then transferring and fixing the formed toner image to a transfer material such as paper.

As miniaturization of various business equipments has been demanded in recent years, miniaturization of the above-mentioned image forming apparatus has been an important problem. In order to deal with the problem, efforts to decrease the diameter of a photosensitive drum which is the center of the apparatus and miniaturize various process means such as charging, exposure, development, and transfer which are arranged in the periphery of the photosensitive drum have been continued.

With respect to a transferring device comprising a transfer roller out of the various process means, however, it has been apparent that sufficient transfer efficiency is not obtained only by reducing a system used for a large-diameter photosensitive drum as the diameter of the photosensitive drum is decreased.

Specifically, when the diameter of the transfer roller is decreased at the same ratio as that in decreasing the diameter of the large-diameter photosensitive drum (not more than approximately 40% of the diameter of the photosensitive drum), an effective transfer region between the photosensitive drum and the transfer roller (a width in the direction of rotation in which transfer is possible) is narrowed, whereby an effective transfer current width in which good transfer is obtained is narrowed, making the setting work of a current value difficult. When the effective transfer region is narrowed as described above, a potential difference between the photosensitive drum and the transfer roller is forced to be set to a large value, resulting in current leakage, reverse transfer of toner, and the like.

The above-mentioned problems are significant in a transferring device having a so-called contact type transfer roller which is so arranged as to be in direct contact with the surface of a photosensitive drum, whereby insufficient transfer such as omission of lines of characters like outline type easily occurs.

Furthermore, the surface of the contact type transfer roller is liable to be contaminated by toner, paper powder or the like, and the electrical resistance of the transfer roller itself is increased by the contamination, whereby good transfer may not be obtained even at a current value set at the beginning. Further, the contamination of the transfer roller may cause the toner to adhere on the reverse surface of a transfer material again, which is a large problem particularly in duplex printing.

Particularly in a transferring device in which a transfer roller is arranged in the position where toner drops by its own weight from the surface of a photosensitive drum, contamination of the transfer roller and the above-mentioned problem caused by the contamination are significant.

SUMMARY OF THE INVENTION

A primary object of the present invention is to provide a transferring device which makes it difficult to cause problems such as current leakage and reverse transfer of toner in the case of miniaturization or contamination of a transfer roller, and easily sets a transfer current because an effective transfer current width is large.

Another object of the present invention is to provide an image forming apparatus using the above-mentioned transferring device.

In order to solve the above-mentioned problems, a transferring device according to the present invention transfers a toner image carried on an organic photosensitive drum having a diameter of 10 to 20 mm to a transfer material, which comprises a transfer roller having a diameter which is not less than 60% of the diameter of the organic photosensitive drum and arranged with a clearance provided between the transfer roller and the organic photosensitive drum.

An image forming apparatus according to the present invention comprises an organic photosensitive drum having a diameter of 10 to 20 mm and the above-mentioned transferring device.

According to the above-mentioned construction, the transfer roller having a diameter which is not less than 60% of the diameter of the organic photosensitive drum having a particular small diameter is combined with the organic photosensitive drum. Therefore, the opposite width therebetween is made larger than that in the prior art in the case of miniaturization, so that an effective transfer current width and an effective transfer region can be ensured, making it difficult to cause current leakage, reverse transfer of toner, and the like. Since the transfer roller and the organic photosensitive drum are arranged with a clearance provided therebetween without being in direct contact with each other, it is difficult to contaminate the transfer roller. Particularly when the transfer roller is so arranged that its center axis is positioned above the center axis of the organic photosensitive drum, the transfer roller may not be contaminated by toner dropping by its own weight from the surface of the organic photosensitive drum, making it more difficult to contaminate the transfer roller.

In the present invention, the reason why the diameter of the organic photosensitive drum is limited to 10 to 20 mm is that process means cannot be substantially arranged around the drum if the diameter is less than the above-mentioned range, whereby the image forming apparatus fails to perform its original function. On the contrary, in a case where the diameter exceeds the above-mentioned range, even if the construction of the present invention is employed, the effect thereof is not significantly obtained as apparent from the results of embodiments as described later, and results contrary to miniaturization which is an initial object of the present invention are produced.

Furthermore, the reason why the diameter of the transfer roller is limited to not less than 60% of the diameter of the organic photosensitive drum is that the effect of increasing the opposite width between the organic photosensitive drum and the transfer roller to ensure an effective transfer current width and an effective transfer region as described above is not obtained if the diameter is less than the range.

The foregoing and other objects, features, aspects and advantages of the present invention will become more apparent from the following detailed description of the present invention when taken in conjunction with the accompanying drawings.

DETAILED DESCRIPTION OF THE INVENTION

Figure 1:
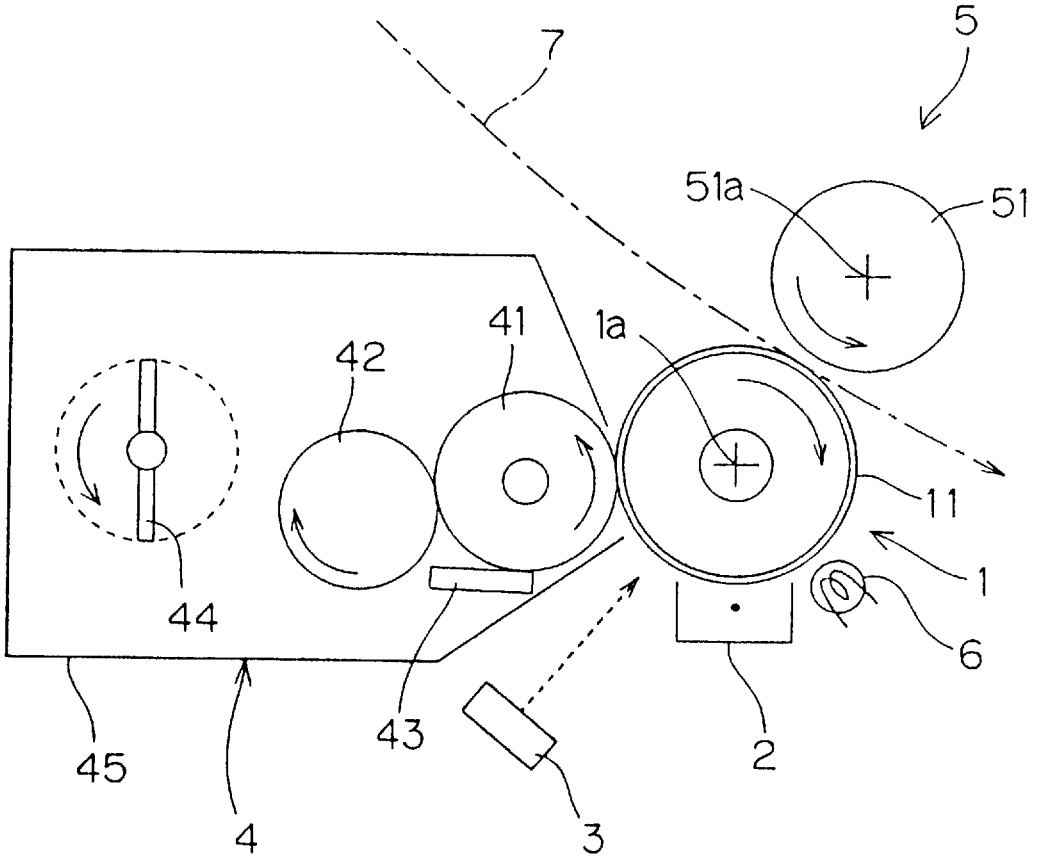
FIG. 1 is a schematic view showing one example of embodiments of a transferring device and an image forming apparatus according to the present invention.

The present invention will be described while referring to FIG. 1 showing one example.

As can be seen from FIG. 1, an image forming apparatus in this example has process means, that is, a corona charger 2, an optical system for image exposure 3, a contact developer unit 4, a transferring device 5, and a charge erasing light source 6 which are arranged in the direction of rotation (indicated by an arrow in FIG. 1) around an organic photosensitive drum 1.

[Corona Charger 2]

The corona charger 2 is for charging the surface of the organic photosensitive drum 1 to a positive and uniform potential, for example, in the case of image formation. It is possible to employ, as the corona charger 2, ones with various systems conventionally known such as a corotron system and a scorotron system. A surface potential of the organic photosensitive drum 1 which is charged by corona charge is generally set in the range of 500 to 1000 V and particularly in the range of 600 to 900 V in terms of absolute values.

[Optical System for Image Exposure 3]

The optical system for image exposure 3 is for exposing the surface of the organic photosensitive drum 1 uniformly charged, which is constituted by a laser light source and a scanning optical system, for example. A potential at a portion onto which laser light is irradiated on the organic photosensitive drum 1 is decreased to 0 V~±200 V by exposure using the optical system for image exposure 3 (indicated by an arrow of a broken line in FIG. 1). On the other hand, a potential at a portion onto which laser light is not irradiated (a background, a dark portion) is held at a dark decay potential from the initial surface potential. As a result, an electrostatic latent image is formed on the surface of the organic photosensitive drum 1.

[Contact Developer Unit 4]

The contact developer unit 4 is for developing the electrostatic latent image by non-magnetic monocomponent toner, which comprises at least a developing roller 41 having its surface formed of elastics and rotated in the opposite direction to the organic photosensitive drum 1 as indicated by an arrow in FIG. 1 in a state where it is pressed against the organic photosensitive drum 1, a sub-roller 42 driven and rotated in the opposite direction as indicated by an arrow in FIG. 1 as the developing roller 41 is rotated in a state where it is pressed against the developing roller 41, a blade 43 pressed against the developing roller 41, agitating means 44 arranged behind the sub-roller 42 and rotated in a direction indicated by an arrow in FIG. 1, and a developing container 45 containing the members and containing the non-magnetic monocomponent toner.

In the contact developer unit 4 comprising the respective sections, when both the developing roller 41 and the sub-roller 42 and the agitating means 44 are respectively rotated in the foregoing directions while applying bias potentials having the same polarity as that of charge in the dark portion of the organic photosensitive drum 1 to the rollers 41 and 42, the toner in the developing container 45 is agitated, is triboelectrically charged to the same polarity as the charging polarity of the organic photosensitive drum 1 to adhere on the surface of the sub-roller 42, and is then moved onto the developing roller 41. In order to smoothly move the toner from the sub-roller 42 to the developing roller 41, it is preferable that a bias voltage slightly higher than a bias voltage applied to the developing roller 41 is applied to the sub-roller 42.

The toner then passes through the blade 43 so that the thickness of a toner layer on the developing roller 41 is controlled to be a predetermined thickness, and the toner forming the toner layer is strongly charged additionally by friction with the blade 43, and is then pressed against the organic photosensitive drum 1 in the nip position between the developing roller 41 and the organic photosensitive drum 1, so that the electrostatic latent image is subjected to reversal development. Specifically, the toner on the surface of the developing roller 41 selectively adheres to the portion at which the potential is decreased by irradiation of laser light as described above in the electrostatic latent image due to a potential difference, so that the electrostatic latent image is developed into a toner image. The excess toner which has not been used for the development is returned to the developing container 45 as the developing roller 41 is rotated, and is used for the subsequent development.

The thickness of the toner layer on the developing roller 41 controlled by the blade 43 is suitably so set as to be generally not more than approximately twice the particle size of the toner. That is, approximately two or less toner layers are suitably formed on the developing roller 41.

[transferring device 5]

The transferring device 5 is so constructed that a transfer roller 51 having a diameter which is not less than 60% of the diameter of the organic photosensitive drum 1 is arranged with a clearance provided between the transfer roller 51 and the organic photosensitive drum 1 and so that its center axis 51*a* is positioned above a center axis 1*a* of the organic photosensitive drum 1.

The reason why the diameter of the transfer roller 51 is limited in the above-mentioned range is as described above. When the diameter of the transfer roller 51 is too large (for example, when it exceeds 150% of the diameter of the organic photosensitive drum 1), a toner image having a width outside of the effective transfer width is also drawn to a transfer material, whereby an image may be fogged. Accordingly, the diameter of the transfer roller 51 is preferably not more than 150%, more preferably not more than 120%, and still more preferably not more than 100% of the diameter of the organic photosensitive drum 1.

Although the clearance between the transfer roller 51 and the organic photosensitive drum 1 is not particularly limited, it is preferable that the clearance between the transfer roller 51 and the organic photosensitive drum 1 which are positioned in closest proximity to each other is approximately 0.1 to 0.7 mm. When the clearance therebetween is less than the above-mentioned range, the effect of preventing the above-mentioned current leakage, reverse transfer of toner, and contamination, and degradation of the organic photosensitive drum 1 by providing the clearance between the transfer roller 51 and the organic photosensitive drum 1 may be insufficient. On the contrary, when the clearance therebetween exceeds the above-mentioned range, sufficient transfer capabilities may not be obtained.

In the above-mentioned transferring device 5, when the transfer roller 51 is rotated in the opposite direction to the organic photosensitive drum 1 as indicated by an arrow in FIG. 1, and charge having polarity opposite to that of the organic photosensitive drum 1 is applied to the transfer roller 51 while passing a transfer material 7 through the clearance therebetween as indicated by an arrow of a one-dot and dash line in FIG. 1, the toner image formed on the surface of the organic photosensitive drum 1 is transferred to the surface of the transfer material 7.

Examples of the other constituent elements, together with the transfer roller 51, constituting the transferring device 5 include a driving system for rotating the transfer roller 51 in the above-mentioned direction, a power supply for applying the above-mentioned potential to the transfer roller 51, and a casing for holding the transfer roller 51 in the above-mentioned position.

The toner image transferred on the surface of the transfer material 7 by the transfer roller 51 is then fixed to the surface of the transfer material 7 by fixing means (not shown).

[Developing Roller 41, transfer roller 51]

A conductive roller obtained by forming in a roller shape a composition obtained by mixing conductive powder with an elastomeric polymer is suitably used as each of the developing roller 41 in the contact developer unit 4 and the transfer roller 51 in the transferring device 5.

It is preferable that the surface resistivity of the conductive roller used as the developing roller 41 is generally in the range of $10^4$ to $10^9$ Ω·cm and particularly in the range of $10^5$ to $10^8$ Ω·cm. If the surface resistivity is higher than the above-mentioned range, it may be difficult to apply a bias voltage. If the surface resistivity is lower than the above-mentioned range, leakage may be caused by discharges on the surface of the organic photosensitive drum 1.

Furthermore, it is preferable that the surface hardness of the developing roller 41 is in the range of 30° to 70° and particularly in the range of 40° to 60° in terms of JIS A Hardness (JIS K6301). If the surface hardness of the developing roller 41 is higher than the above-mentioned range, it may be difficult to bring the toner layer into uniform contact with the surface of the organic photosensitive drum 1, and the organic photosensitive drum 1 may easily wear away. If the surface hardness is lower than the above-mentioned range, it may be difficult to transmit sufficient pressure, and the developing roller 41 may easily wear away.

On the other hand, it is preferable that the volume resistivity of the conductive roller used as the transfer roller 51 is generally in the range of $10^6$ to $10^{14}$ Ω·cm$^2$. When the volume resistivity is higher than the above-mentioned range, it may be difficult to apply a transfer voltage.

Furthermore, it is preferable that the surface hardness of the transfer roller 51 is not less than 50° in terms of JIS A Hardness. When the surface hardness of the transfer roller 51 is lower than the above-mentioned range, the circularity of a cross section of the roller is decreased, whereby sufficient surface precision may not be obtained.

In order to adjust the surface resistivity, the volume resistivity, and the surface hardness of each of the rollers 41 and 51 in the above-mentioned suitable ranges, the mixing amounts of the following respective components may be adjusted.

Examples of an elastomeric polymer used for both the rollers 41 and 51 include nitrile butadiene rubber (NBR), styrene butadiene rubber (SBR), polychloroprene (CR), polybutadiene (BR), polyisoprene rubber (IR), butyl rubber (IIR), natural rubber, ethylene-propylene copolymer (EPM), ethylene-propylene-diene terpolymer (EPDM), polyurethane, silicone rubber, fluorocarbon rubber, chlorinated polyethylene, chlorinated polypropylene, and elastomeric polyvinyl chloride, which are not limitations.

Furthermore, it is preferable to use, as the conductive powder, any one of (i) conductive carbon black, (ii) tin oxide doped by indium, ammonium, etc., and (iii) metal powder of copper, silver, aluminum, etc. The conductive carbon black in the item (i) is preferable.

In the case of the transfer roller 51, it is preferable that the content of the conductive fine powder is in the range of 5 to 70% by weight and particularly in the range of 10 to 50% by weight per the total amount of the composition in order to set the volume resistivity thereof in the above-mentioned suitable range.

Various additives which are themselves known, for example, (a) plasticizers and softening agents for adjusting the surface hardness, (b) sulfur or organic vulcanizing agents, vulcanization accelerators, vulcanization supplement accelerators, and vulcanization retarders for vulcanizing the rubber when the elastomeric polymer is vulcanizable rubber, and (c) antioxidants, fillers, reinforcing agents, dispersants, and the like as the other components can be mixed with the composition in their own known mixing amounts.

Furthermore, in order to adjust the surface hardness of each of the developing roller 41 and the transfer roller 51, a foaming agent may be also mixed with the composition to foam the composition simultaneously with the formation or the vulcanization and form a sponge layer inside of the roller.

Both the above-mentioned rollers 41 and 51 are fabricated by respectively forming the composition containing the above-mentioned components in a roller shape as described above, further heating and vulcanizing, when the elastomeric polymer is vulcanizable rubber, the rubber.

[Charge Erasing Light Source 6]

The charge erasing light source 6 is for exposing the entire surface of the organic photosensitive drum 1 after transferring the toner image on the transfer material 7 to eliminate charge. Specifically, light having a wavelength in which the organic photosensitive drum 1 has sensitivity is irradiated from the charge erasing light source 6, whereby the electrostatic latent image on the surface of the organic photosensitive drum 1 is erased.

[Organic Photosensitive Drum 1]

As the organic photosensitive drum 1, one having a diameter of 10 to 20 mm and having an organic photosensitive layer 11 formed on its surface is used, as described above. The reason why the diameter is limited in the above-mentioned range is as described above.

The organic photosensitive drum 1 itself is constructed with the organic photosensitive layer 11 formed directly on a cylinder-shaped conductive substrate or the organic photosensitive layer 11 formed on a flat plate-shaped conductive substrate winding around a cylindrical body.

As the organic photosensitive layer 11, any of conventionally known ones having various structures can be employed. Particularly, an organic photosensitive layer of a single-layer dispersion type in which at least a charge generating material and a charge transferring material are dispersed in a binder resin is suitably employed. The reason for this is that the surface of the organic photosensitive layer of a single-layer dispersion type has high activity. If the organic photosensitive layer is combined with a contact type transfer roller, the deterioration thereof is promoted. However, such a problem does not easily arise when it is combined with a so-called non-contact type transfer roller which is arranged with a clearance provided therebetween without being in direct contact with the surface of the organic photosensitive drum 1 as described above, so that superior properties of the organic photosensitive layer of a single-layer dispersion type can be sufficiently exhibited.

Examples of an organic photosensitive layer other than the organic photosensitive layer of a single-layer dispersion type include a so-called organic photosensitive layer of a lamination type in which a charge generating layer containing a charge generating material and a charge transferring layer containing a charge transferring material are laminated in this order or in the opposite order.

Examples of the charge generating material in each of materials composing the organic photosensitive layer 11 include azo pigments, bisazo pigments, anthanthrone pigments, phthalocyanine pigments, indigo pigments, indanthrene pigments, toluidine pigments, pyrazoline pigments, perylene pigments, and quinacridone pigments. The pigments are used independently or in combination in order to have an absorption wavelength in a desired range, that is, have sensitivity to light from the optical system for image exposure 3. Examples of pigments having high sensitivity to the above-mentioned laser light include phthalocyanine pigments. Examples of the phthalocyanine pigments include X-type metal-free phthalocyanine, and oxotitanyl phthalocyanine.

As the charge transferring material, arbitrary ones, which are themselves known, having electron transferring properties or hole transferring properties can be used. The suitable examples are as follows.

Examples of the charge transferring material having electron transferring properties (electron transferring material) include electron attractive materials such as p-diphenoquinone derivatives, benzoquinone derivatives, naphthoquinone derivatives, tetracyanoetylene, tetracyanoquinodimethane, chloranil, bromoanil, 2, 4, 7-trinitro-9-fluorenone, 2, 4, 5, 7-tetranitro-9-fluorenone, 2, 4, 7-trinitro-9-dicyanomethylene fluorenone, 2, 4, 5, 7-tetranitroxanthone, and 2, 4, 8-trinitrothioxanthone, and polymerized materials of above electron attractive materials.

Since the p-diphenoquinone derivatives and particularly, asymmetrical type p-diphenoquinone derivatives out of the foregoing materials are suitably used because they are superior in electron transferring properties and are superior in solubility in a solvent and compatibility with binder resins due to low symmetry of molecules and low interaction between molecules.

Examples of the asymmetrical type p-diphenoquinone include 3, 5-dimethyl-3', 5'-di-tert-butyl diphenoquinone, 3, 5-dimethoxy-3', 5'-di-tert-butyl diphenoquinone, 3, 3'-dimethyl-5, 5'-di-tert-butyl diphenoquinone, 3, 5'-dimethyl-3', 5-di-tert-butyl diphenoquinone which are not limitations. Other examples of p-diphenoquinone include 3, 5, 3', 5'-tetramethyl diphenoquinone, 2, 6, 2', 6'-tetra-tert-butyl diphenoquinone, 3,5,3',5'-tetraphenyl diphenoquinone, and 3,5,3 ',5'-tetracyclohexyl diphenoquinone, which are not limitations.

On the other hand, known examples of the charge transferring material having hole transferring properties (hole transferring material) are as follows. Out of the charge transferring materials, ones superior in hole transferring properties and superior in solubility in a solvent and compatibility with binder resins are used.

Pyrene, N, N-diphenylhydrazino-3-methylidene-10-ethyl phenothiazine, N, N-diphenylhydrazino-3-methylidene-10-ethyl phenoxazine, triphenylamine, and the like, Carbazole derivatives such as N-ethyl carbazole, N-isopropyl carbazole, N-methyl-N-phenylhydrazino-3-methylidene-9-carbazole, and N, N-diphenylhydrazino-3-methylidene-9-ethyl carbazole, Hydrazone salts such as p-diethylaminobenzaldehyde-N, N-diphenylhydrazone, p-diethylaminobenzaldehyde-α-naphthyl-N-phenylhydrazone, p-pyrrolidinobenzaldehyde-N, N-diphenylhydrazone, 1, 3, 3-trimethylindolenine-ω-aldehyde-N, N-diphenylhydrazone, and p-diethylbenzaldehyde-3-methylbenzthiazoline-2-hydrazone, Pyrazoline derivatives such as 2, 5-bis(p-diethylaminophenyl)-1, 3, 4-oxadiazole, 1-phenyl-3-(p-diethylaminostyryl)-5-(p-diethylaminophenyl) pyrazoline, 1-[quinonyl (2)]-3-(p-diethylaminostyryl)-5-(p-diethylaminophenyl) pyrazoline, 1-[pyridyl (2)]-3-(p-diethylaminostyryl)-5-(p-diethylaminophenyl) pyrazoline, 1-[6-methoxy-pyridyl (2)]-3-(p-diethylaminostyryl)-5-(p-diethylaminophenyl) pyrazoline, 1-[pyridyl (3)]-3-(p-diethylaminostyryl)-5-(p-diethylaminophenyl) pyrazoline, 1-[lepidyl (3)]-3-(p-diethylaminostyryl)-5-(p-diethylaminophenyl) pyrazoline, 1-[pyridyl (2)]-3-(p-diethylaminostyryl)-4-methyl-5-(p-diethylaminophenyl) pyrazoline, 1-[pyridyl (2)]-3-(α-methyl-p-diethylaminostyryl)-3-(p-diethylaminophenyl) pyrazoline, 1-phenyl-3-(p-diethylaminostyryl)-4-methyl-5-(p-diethylaminophenyl) pyrazoline, and spiropyrazoline, Oxadiazole compounds such as 2-(p-diethylaminostyryl)-3-diethylaminobenzoxazole, and 2-(p-diethylaminophenyl)-4-(p-dimethylaminophenyl)-5-(2-chlorophenyl) oxazole, Thiazole compounds such as 2-(p-diethylaminostyryl)-6-diethylaminobenzothiazole, Triallyl methane compounds such as bis(4-diethylamino-2-methylphenyl) phenyl methane, Polyaryl alkane compounds such as 1, 1-bis(4-N, N-diethylamino-2-methylphenyl) heptane, and 1, 1, 2, 2-tetrakis(4-N, N-dimethylamino-2-methylphenyl) ethane, Benzidine compounds such as N, N'-diphenyl-N, N'-bis (methylphenyl) benzidine, N, N'-diphenyl-N, N'-bis (ethylphenyl) benzidine, N, N'-diphenyl-N, N'-bis (butylphenyl) benzidine, N, N'-diphenyl-N, N'-bis (propylphenyl) benzidine, N, N'-bis(isopropylphenyl) benzidine, N, N'-diphenyl-N, N'-bis(sec-butylphenyl) benzidine, N, N'-diphenyl-N, N'-bis(tert-butylphenyl) benzidine, N, N'-diphenyl-N, N'-bis(2, 4-dimethylphenyl) benzidine, and N, N'-diphenyl-N, N'-bis(chlorophenyl) benzidine, Polymers such as poly-N-vinyl carbazole, polyvinyl pyrene, polyvinyl anthracene, polyvinyl acridine, poly-9-vinyl phenyl anthracene, pyrene-formaldehyde resin, and ethyl carbazole formaldehyde resin.

The suitable examples of the hole transferring material are aromatic amine derivatives, and particularly benzidine derivatives and phenylenediamine derivatives out of the foregoing. The other suitable examples of the hole transferring material include hydrazone derivatives, and particularly carbazole hydrazone derivatives.

In terms of sensitivity and such wide application that reversal development is made possible, an electron transferring material (ET) and a hole transferring material (HT) are preferably used in combination. In this case, it is preferable that the weight ratio of ET and HT is in the range of 10:1 to 1:10, and particularly in the range of 1:5 to 1:1.

Various resins can be used as binder resins for dispersing the charge transferring material and charge generating material. Examples are styrene polymer, acrylic polymer, styrene-acrylic copolymer, ethylene-vinyl acetate copolymer, polypropylene, olefin copolymers such as ionomer, polyvinyl chloride, vinyl chloride-vinyl acetate copolymer, polyester, alkyd resin, polyamide, polyurethane, epoxy resin, polycarbonate, polyalylate, polysulfone, diallyl phthalate resin, silicone resin, ketone resin, polyvinyl butyral resin, polyether resin, phenol resin, and light curable resins such as epoxy acrylate. The binder resins can be also used independently or in combination. The suitable resins are styrene polymer, acrylic polymer, styrene-acrylic copolymer, polyester, alkyd resin, polycarbonate, and polyacrylate. The particularly suitable resin is polycarbonate, for example, registered trade name "Panlite" manufactured by Teijin Limited and "PCZ" manufactured by Mitsubishi Gas Chemical Company, Inc.

Various additives which are themselves known, for example, antioxidants, radical scavengers, singlet quenchers, UV absorbers, softeners, surface modifiers, antifoaming agents, extenders, thickeners, dispersion stabilizers, waxes, acceptors, and donors can be mixed with the organic photosensitive layer 11 in the range in which electrophotographic properties are not adversely affected.

Furthermore, when 1 to 5% by weight of a steric hindrance phenolic antioxidizing agent is mixed per total solid content, the durability of the organic photosensitive layer 11 can be significantly improved without adversely affecting the electrophotographic properties.

As a conductive substrate forming the organic photosensitive layer 11, one composed of various materials having conductivity can be used. Examples include one in a cylinder shape or a flat plate shape composed of metals or alloys such as aluminum, iron, copper, tin, platinum, gold, silver, vanadium, molybdenum, chromium, cadmium, titanium, nickel, indium, stainless steel and brass, plastic materials having the above-mentioned metal deposited or laminated thereon, glass coated with aluminum iodide, tin oxide, and indium oxide, and the like. It is particularly preferable to use a general aluminum tube, and particularly a tube so subjected to alumite processing that the thickness thereof becomes 1 to 50 $\mu$m.

The organic photosensitive layer of a single-layer dispersion type may be formed by mixing a charge generating material with a solution containing a charge transferring material, a binder resin, or the like, and dispersing a mixture obtained using a conventionally know method, for example, a roll mill, a ball mill, an atriter, a paint shaker, a supersonic disperser, or the like, to prepare a coating solution, then applying the coating solution on the conductive substrate by conventionally known coating means and drying the coating solution.

Although on the single-layer dispersion type organic photosensitive layer, the charge generating material, the charge transferring material and the binder resin can be used in various ratios, 5 to 1000 parts by weight and preferably 30 to 500 parts by weight of the charge generating material, and 10 to 500 parts by weight and preferably 25 to 100 parts by weight of the charge transferring material are respectively mixed per 100 parts by weight of the binder resin.

Although the thickness of the single-layer dispersion type organic photosensitive layer is not particularly limited, it is preferable that it is generally in the range of 10 to 40 $\mu$m and particularly in the range of 20 to 35 $\mu$m.

On the other hand, an organic photosensitive layer of a lamination type may be obtained by first forming a charge generating layer containing a charge generating material using means such as deposition or coating on a conductive substrate, then applying a coating solution containing a charge transferring material and a binder resin on the charge generating layer, and drying the coating solution to form a charge transferring layer, or forming both the layers in the opposite order.

Although in the lamination type organic photosensitive layer, the charge generating material composing the charge generating layer and the binder resin can be used in various ratios, 5 to 1000 parts by weight and preferably 30 to 500 parts by weight of the charge generating material is suitably mixed per 100 parts by weight of the binder resin. The charge transferring material composing the charge transferring layer and the binder resin can be used in various ratios in the range in which charge is not prevented from being transported and in the range in which the charge transferring material is not deposited upon being crystallized.

Generally as the thickness of the lamination type organic photosensitive layer, the thickness of the charge generating layer is approximately 0.01 to 5 $\mu$m and preferably approximately 0.1 to 3 $\mu$m, and the thickness of the charge transferring layer is 2 to 100 $\mu$m and preferably approximately 5 to 50 $\mu$m.

A barrier layer may be formed in the range in which the characteristics of the organic photosensitive drum are not prevented between the conductive substrate and the organic photosensitive layer in the organic photosensitive drum having the single-layer dispersion type organic photosensitive layer, or between the conductive substrate and the charge generating layer, between the conductive substrate and the charge transferring layer, or between the charge generating layer and the charge transferring layer in the organic photosensitive drum having the lamination type organic photosensitive layer. Further, a protective layer may be formed on the surface of the organic photosensitive layer.

As a solvent used for forming the coating solution, various organic solvents can be used. Examples are alcohols such as methanol, ethanol, isopropanol and butanol, aliphatic hydrocarbons such as n-hexane, octane and cyclohexane, aromatic hydrocarbons such as benzene, toluene and xylene, halogenated hydrocarbons such as dichloromethane, dichloroethane, carbon tetrachloride and chlorobenzene, ethers such as dimethyl ether, diethyl ether, tetrahydrofuran, ethylene glycol dimethyl ether and diethylene glycol dimethyl ether, ketones such as acetone, methyl ethyl ketone and cyclohexanone, esters such as ethyl acetate and methyl acetate, dimethylformamide and dimethyl sulfoxide. They are used independently or in combination. It is preferable that the solid concentration of the coating solution is generally 5 to 50%.

[Toner]

In the example as illustrated, non-magnetic monocomponent toner is used as toner, as described above. The toner contains as its composition a fixing resin, a coloring material or the like. Particularly, the toner is preferably spherical. Although such spherical toner is produced in various methods, toner produced particularly by a polymerization method is suitably used because it is spherical and has a narrow particle size distribution.

The spherical toner produced by a polymerization method is produced by suspension polymerizing in an aqueous medium a composition for toner formation containing a vinyl monomer to be a fixing resin, a radical polymerization initiator capable of polymerizing the vinyl monomer, a coloring material, and the like.

As the vinyl monomer which can form the fixing resin, one to be a thermoplastic resin which is itself waterinsoluble and has fixing properties and voltage detecting properties by polymerization is used. Examples of such a vinyl monomer include aromatic vinyl monomers, acrylic monomers, vinyl ester monomers, vinyl ether monomers, diolefin monomers, and mono-olefin monomers.

Examples of the aromatic vinyl monomers out of the foregoing include styrene, α-methylstyrene, vinyltoluene, α-chlorostyrene, o-, m-, p-chlorostyrene, p-ethylstyrene, and divinylbenzene.

Examples of the acrylic monomers include methyl acrylate, ethyl acrylate, butyl acrylate, 2-ethylhexyl acrylate, cyclohexyl acrylate, phenyl acrylate, methyl methacrylate, hexyl methacrylate, 2-ethylhexyl methacrylate, ethyl-β-hydroxyacrylate, propyl-γ-hydroxyacrylate, butyl-δ-hydroxyacrylate, ethyl-β-hydroxymethacrylate, ethylene glycol dimethacrylate ester, and tetraethylene glycol dimethacrylate ester.

Examples of the other monomers are vinyl esters such as vinyl formate, vinyl acetate, and vinyl propionate, vinyl ethers such as vinyl-n-butyl ether, vinyl phenyl ether, and vinylcyclohexyl ether, diolefins such as butadiene, isoprene, and chloroprene, mono-olefins such as ethylene, propylene, isobutylene, butene-1, pentene-1, and 4-methylpentene-1.

The suitable monomers are a styrene monomer, acrylic monomers, and the like.

The vinyl monomers are used independently or in combination.

Examples of the radical polymerization initiator include radical polymer initiators which are themselves known, for example, azo compounds, hydroperoxides, peroxides, peracid type initiators, and redox type initiators. The suitable examples of the initiator are as follows.

2, 2'-azobisisobutyronitrile, 2, 2'-azobis(2, 4-dimethylvaleronitrile), 2, 2'-azobis(2-cyclopropyl propionitrile), 2, 2'-azobis(4-methoxy-2, 4-dimethylvaleronitrile), 1, 1'-azobis(1-cyclohexane carbonitrile), benzoyl peroxide, and (1-phenylethyl) azodiphenylmethane.

The radical polymer initiator is used in the range of 0.3 to 5 parts by weight and particularly in the range of 0.5 to 3 parts by weight per 100 parts by weight of the vinyl monomer.

In order to provide a charge control function, a monomer containing a charge controllable functional group which can be copolymerized with the vinyl monomer may be used. Examples of such a monomer include radical polymerizable monomers having electrolytic groups such as anionic groups of a sulfonic acid type, a phosphoric acid type and a carboxylic acid type, and cationic groups such as a primary, secondary or tertiary amino group and a quarternary ammonium group. The suitable examples are as follows.

Styrene sulfonate, sodium styrene sulfonate, 2-acrylamide-2-methylpropane sulfonate, 2-acid phosphoxy propyl methacrylate, 2-acid phosphoxy ethyl methacrylate, 3-chloro 2-acid phosphoxy propyl methacrylate, acrylic acid, methacrylic acid, fumaric acid, crotonic acid, tetrahydroterephthalate, itaconic acid, aminostyrene, aminoethyl methacrylate, aminopropyl acrylate, diethylaminopropyl acrylate, γ-N-(N', N'-diethylaminoethyl) aminopropyl methacrylate, and trimethyl ammonium propyl methacrylate.

The above-mentioned monomer is used in the range of 0.1 to 5 parts by weight and particularly in the range of 0.3 to 1 parts by weight per 100 parts by weight of the vinyl monomer.

Furthermore, a charge control group may be introduced into a terminal of a polymer using the radical initiator having an electrolytic group such as an above-mentioned cationic group.

As the coloring material, inorganic or organic pigments and dyes as shown below, for example, are used independently or in combination.

Carbon black such as furnace black and channel black,

Black iron oxide such as triiron tetroxide,

Titanium dioxide having a rutile structure or an anatase structure,

Phthalocyanine blue, phthalocyanine green, cadmium yellow, molybdenum orange, pyrazolone red, fast violet B, etc.

The above-mentioned coloring material is used in the range of 3 to 30 parts by weight (3 to 100 parts by weight in the case of iron black such as triiron tetroxide) and particularly in the range of 5 to 10 parts by weight per 100 parts by weight of the vinyl monomer.

In producing toner by a polymerization method, a composition for toner formation containing a vinyl monomer is suspended in an aqueous medium, as described above. In this case, the concentration of the composition is suitably set to generally 1 to 50% by weight and particularly 5 to 30% by weight, and the size of suspended particles is suitably adjusted to generally 4 to 20 μm and particularly 5 to 13 μm.

In order to stabilize the suspended state of the composition for toner formation, a dispersion stabilizer can be also used as required. Suitably used examples of such a dispersion stabilizer include polymers soluble in an aqueous medium, for example, polyvinyl alcohol, methyl cellulose, ethyl cellulose, polyacrylic acid, polyacrylamide, polyethylene oxide, poly(hydroxy stearate-g-methyl methacrylate-CO-methacrylic acid) copolymers, a nonionic or ionic surface active material, and inorganic powder of calcium phosphate or the like. It is preferable that the dispersion stabilizer is added in the ratio of 0.1 to 10% by weight and particularly 0.5 to 5% by weight in a system.

It is preferable that the amount of the initiator in the composition for toner formation is in the range of 0.3 to 30% by weight and particularly 0.5 to 10% by weight with the monomer used as a basis.

In the case of the polymerization, a system of reaction is replaced with inert gas such as nitrogen, to perform polymerization at temperatures of 40° to 100° C. and particularly 50° to 90° C. while maintaining the above-mentioned suspended state. In this case, gentle agitation may be performed in order to homogenize the system of reaction.

Since a polymer product after reaction is obtained in the form of particles in the above-mentioned range of the particle size, produced particles are filtered, are cleaned by water or a suitable solvent as required, and are dried, to form toner particles.

In the present invention, spherical toner can be also produced by the other method. Examples of such spherical toner produced by the other method include toner obtained by melting and making spherical in a hot air current irregular shaped particles obtained by kneading, grinding, classifying a resin composition for toner formation containing fixing resin, a coloring material, a charge controlling material, a mold release material, or the like, toner obtained by spraying a molten material of the resin composition for toner formation into a heat atmosphere to granulate the molten material in a spherical shape, and toner obtained by spraying a solution of the resin composition for toner formation into an air current and drying the solution to granulate the solution in a spherical shape.

As the fixing resin of the toner produced by each of the above-mentioned methods, various thermoplastic resins having fixing properties and voltage detecting properties and thermoplastic resins in the form of an uncured or initial condensate are used. Examples of such a fixing resin include acrylic resin, polyvinyl acetal resin, polyester resin, epoxy resin, phenol resin, petroleum resin, polyolefin resin and aromatic vinyl resins such as polystyrene. Styrene resin, acrylic resin or styrene-acrylic copolymer resin out of the foregoing resins is suitably used. It is preferable that a cationic or anionic polar group is contained in the fixing resin in the form of a blend or a copolymer.

The same as the foregoing is used as the coloring material. The coloring material is used in the ratio of 5 to 20 parts by weight and particularly in the ratio of 10 to 15 parts by weight per 100 parts by weight of the fixing resin.

As the charge control material, it is possible to use ones which are themselves known, for example, nigrosine base (C. I. No. 5045) and oil black (C. I. No. 26150), oil-soluble dyes such as spiron black, metallic naphthenate, fatty acid metal soap, and metal complex salt dyes. In addition thereto, it is also possible to use resins containing a charge controllable functional group. Examples of the functional group include electrolytic groups such as anionic groups of a sulfonic acid type, a phosphoric acid type and a carboxylic acid type, and cationic groups such as primary, a secondary or tertiary amino group and a quarternary ammonium group.

The charge controlling material is preferably used in the ratio of 1 to 10 parts by weight per 100 parts by weight of the fixing resin.

Examples of the mold release material for heat fixing include various waxes and low-molecular weight olefin resins. As the olefin resins, ones having a number-average molecular weight (Mn) in the range of 1000 to 10000 and particularly in the range of 2000 to 6000 are preferable. As the olefin resins, polypropylene, polyethylene, and a propylene-ethylene copolymer are used. Polypropylene is particularly suitable.

It is preferable that the mold release material is used in the ratio of 1 to 10 parts by weight per 100 parts by weight of the fixing resin 100.

It is preferable that the particle size of the toner (a volume-base average particle diameter) is approximately 5 to 15 $\mu$m.

It is preferable to improve the flowability of the toner to increase the bulk density thereof. For this purpose, the toner is powdered with a flowability modifier such as carbon black, hydrophobic amorphous silica, hydrophobic finely-divided alumina, fine titanium oxide or fine spherical resin, to be final non-magnetic monocomponent toner. The flowability modifier is preferably used in the ratio of 0.01 to 2.0% by weight per the toner.

The toner is not limited to the spherical toner. Irregular shaped toner obtained by kneading, grinding, and classifying the above-mentioned resin composition for toner formation may be used.

As described in detail above, according to the present invention, there are provided a transferring device which does not easily cause problems such as current leakage and reverse transfer of toner in the case of miniaturization or contamination of a transfer roller and easily sets a transfer current because an effective transfer current width is large. If the construction of the present invention is employed, therefore, such a peculiar function and effect that the image forming apparatus can be further miniaturized in a state where the image quality of a formed image is maintained are produced.

EXAMPLES

The present invention will be described on the basis of following examples.

[Fabrication of Organic Photosensitive Drum]

Component;

metal-free phthalocyanine (a charge generating material) : 5 parts by weight

N, N'-diphenyl-N, N'-bis (2, 4-dimethylphenyl) benzidine (a hole transferring material) : 40 parts by weight 3, 5, 3', 5'-tetraphenyl diphenoquinone (an electron transferring material) : 40 parts by weight polycarbonate (a binder resin) : 100 parts by weight dichloromethane (a solvent) : 800 parts by weight A coating solution produced by mixing and dispersing the above-mentioned respective components by a ball mill was applied on an aluminum tube by a dip coating method, and was then hot-air dried at a temperature of 60° C. for sixty minutes, to fabricate organic photosensitive drums each having a single-layer dispersion type organic photosensitive layer having a thickness of 30 $\mu$m and respectively having diameters of 10 mm, 16 mm, 20 mm, 25 mm and 30 mm.

[Fabrication of Image Forming Apparatus]

A plain paper facsimile LDC-650 manufactured by Mita Industrial Company, Ltd. is converted for experiments. Specifically, in the direction of rotation of an organic photosensitive drum 1 fabricated in the above-mentioned manner, a corona charger 2 with a scorotron system having a grid, an optical system for image exposure 3 comprising a laser light source and a scanning optical system, a contact developer unit 4 for non-magnetic monocomponent toner, a transferring device having a non-contact type transfer roller 51 having any one of diameters 5 mm, 6 mm, 8 mm, 9.6 mm, 10 mm, 12 mm and 14 mm so arranged therein that its center axis 51*a* is positioned above the center axis 1*a* of the organic photosensitive drum 1, and a charge erasing light source 6 are arranged, as shown in FIG. 1. The clearance between of the photosensitive drum 1 and the transfer roller 51 which are positioned in closest proximity to each other is set to 0.3 mm.

[Image Formation Test 1]

A sample image is continuously formed on 10000 sheets by setting the peripheral speed of the organic photosensitive drum 1 in the image forming apparatus fabricated in the above-mentioned manner to 56 mm/sec and while applying charge having polarity opposite to that of the organic photosensitive drum 1 to the non-contact type transfer roller 51 so that a transfer current of 6 $\mu$A flows in constant current control.

A sample image on the 10000-th sheet is visually judged, to evaluate a case where the image is bad due to at least one of a defect caused by leakage or reverse transfer (omission from a black point or a solid image) and offset (double, i.e., ghost) as bad and evaluate a case where the image is good because there is neither defect and the offset as good. The results are shown in Table 1. In Table 1, (-) indicates a combination in which no test is carried out.

TABLE 1

| | | diameter of organic photosensitive drum | | | | |
|---|---|---|---|---|---|---|
| | | 10 mm | 16 mm | 20 mm | 25 mm | 30 mm |
| diameter of transfer roller | 14 mm | Good | Good | Good | Good | Good |
| | 12 mm | Good | Good | Good | Good | Good |
| | 10 mm | Good | — | Bad | Good | Good |
| | 9.6 mm | — | Good | — | — | — |
| | 8 mm | Good | Bad | Bad | Bad | — |
| | 6 mm | Good | — | — | — | — |

TABLE 1-continued

| | diameter of organic photosensitive drum | | | | |
|---|---|---|---|---|---|
| | 10 mm | 16 mm | 20 mm | 25 mm | 30 mm |
| 5 mm | Bad | Bad | Bad | Bad | Bad |

From the results shown in Table 1, in the range in which the diameter of the organic photosensitive drum exceeds 20 mm, the diameter of the transfer roller does not significantly affect the formed image. In the range in which the diameter of the organic photosensitive drum is 10 to 20 mm, a large difference occurs in the quality of the formed image depending on whether the diameter of the transfer roller is not less than 60% or less than 60% of the diameter of the organic photosensitive drum. This indicates that the diameter of the transfer roller must be not less than 60% of the diameter of the organic photosensitive drum.

[Image Formation Test II]

In the above-mentioned image forming apparatus, when an organic photosensitive drum 1 having a diameter of 16 mm is combined with a non-contact type transfer roller 51 having any one of diameters of 8 mm, 9 mm, 10 mm and 12 mm, an effective transfer current width in which good transfer is obtained on the first sheet on which an image is found. Further, a sample image on the 1000-th sheet image is visually judged in a case where the sample image is continuously formed under the same conditions as those in the above-mentioned test I, and is evaluated on the same basis as the foregoing. The results are shown in Table 2. In Table 2, numerals in a parenthesis in the column of the effective transfer current width indicate upper and lower limit values of the actual effective transfer current.

TABLE 2 diameter of organic photosensitive drum A = 16 mm

| diameter of transfer roller mm (=B) | B/A ×100% | effective transfer current width on first sheet μA | image on 1000th sheet |
|---|---|---|---|
| 12 | 75.0 | 10 (2–12) | Good |
| 10 | 62.5 | 6 (2–8) | Good |
| 9 | 56.3 | 0.2 (4–4.2) | Bad |
| 8 | 50.0 | 0 (3) | Bad |

As can be seen from the results shown in Table 2, when the diameter of the transfer roller is less than 60% of the diameter of the organic photosensitive drum, the effective transfer current width is zero or is significantly small, and the quality of the formed image is bad. On the other hand, when the diameter of the transfer roller is not less than 60% of the diameter of the organic photosensitive drum, the effective transfer current width is large, and the quality of the formed image is good.

[Image Formation Test III]

In the above-mentioned image forming apparatus, when an organic photosensitive drum 1 having a diameter of 10 mm is combined with a non-contact type transfer roller 51 having any one of diameters of 4 mm, 5 mm, 6 mm and 7.5 mm, an effective transfer current width is obtained in which good transfer is obtained on the first sheet on which an image is found. A sample image on the 1000th sheet is visually judged in a case where the sample image is continuously formed under the same conditions as those in the above-mentioned test I, and is evaluated on the same basis as the foregoing. The results are shown in Table 3. In Table 3, numerals in a parenthesis in the column of the effective transfer current width indicate upper and lower limit values of an actual effective transfer current, as in the case of the previous test II.

TABLE 3 diameter of organic photosensitive drum A = 10 mm

| diameter of transfer roller mm (=B) | B/A ×100% | effective transfer current width on first sheet μA | image on 1000th sheet |
|---|---|---|---|
| 7.5 | 75.0 | 8 (3–11) | Good |
| 6 | 60.0 | 4 (3–7) | Good |
| 5 | 50.0 | cannot be set | Bad |
| 4 | 40.0 | cannot be set | Bad |

As can be seen from the results shown in Table 3, when the diameter of the transfer roller is less than 60% of the diameter of the organic photosensitive drum, the effective transfer current cannot be set, and the quality of the formed image is bad. On the other hand, when the diameter of the transfer roller is not less than 60% of the diameter of the organic photosensitive drum, the effective transfer current width is large, and the quality of the formed image is good.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A transferring device for transferring a toner image carried on an organic photosensitive drum having a diameter of 10 to 20 mm to a transfer material, comprising a transfer roller having a diameter which is not less than 60% of the diameter of the organic photosensitive drum and arranged with a clearance provided between the transfer roller and the organic photosensitive drum.

2. The transferring device according to claim 1, wherein the transfer roller is so arranged that its center axis is positioned above the center axis of the organic photosensitive drum.

3. The transferring device according to claim 1, wherein the diameter of the transfer roller is not more than 150% of the diameter of the organic photosensitive drum.

4. An image forming apparatus comprising an organic photosensitive drum having a diameter of 10 to 20 mm and the transferring device according to claim 1 or 2.

5. The image forming apparatus according to claim 4, wherein the organic photosensitive drum has an organic photosensitive layer of a single-layer dispersion type in which at least a charge generating material and a charge transferring material are dispersed in a binder resin.

6. The image forming apparatus according to claim 4, wherein the clearance between the organic photosensitive drum and the transfer roller which are positioned in closest proximity to each other is 0.1 to 0.7 mm.

* * * * *